US006321422B1

(12) United States Patent
Fildan et al.

(10) Patent No.: US 6,321,422 B1
(45) Date of Patent: Nov. 27, 2001

(54) BUTTON CLIP, ESPECIALLY FOR A STRAPLESS BRASSIERE

(75) Inventors: Gerhard Fildan, Vienna; Karl Wanzenböck, Leobersdorf, both of (AT)

(73) Assignee: Fildan Accessories Corporation, Englewood, NJ (US)

( * ) Notice: Subject to any disclaimer, the term of this patent is extended or adjusted under 35 U.S.C. 154(b) by 0 days.

(21) Appl. No.: 09/578,614

(22) Filed: May 25, 2000

(51) Int. Cl.[7] ..... A41C 3/00; A44B 21/00
(52) U.S. Cl. ..... 24/537; 24/337; 450/86
(58) Field of Search ..... 24/265 EC, 265 BC, 24/537, 298–302, 336, 337; 2/265; 450/86, 82, 88

(56) References Cited

U.S. PATENT DOCUMENTS

| | | | | |
|---|---|---|---|---|
| 391,772 | * | 10/1888 | Armstrong | 24/337 |
| 701,998 | * | 6/1902 | Douglas | 24/337 X |
| 893,466 | * | 7/1908 | Durham | 24/537 X |
| 1,110,579 | * | 9/1914 | Seeber | 24/537 |
| 1,374,485 | * | 4/1921 | Berecky et al. | 24/337 |
| 1,513,099 | * | 10/1924 | Fox | 24/537 X |
| 3,100,324 | * | 8/1963 | Tutino et al. | 24/537 X |
| 5,388,313 | * | 2/1995 | Cameron | 24/537 |

* cited by examiner

*Primary Examiner*—Robert J. Sandy
(74) *Attorney, Agent, or Firm*—Herbert Dubno

(57) ABSTRACT

A button clip, especially for the attachment of a strap to a strapless brassiere, has a pair of tongues which can be clamped against the strapless brassiere by the movement of a slider therealong. The slider has the configuration of a button with a hole in its center through which a tongue surface is visible. The tongues are attached to the strap by a pair of plates.

22 Claims, 6 Drawing Sheets

BUTTON CLIP, ESPECIALLY FOR A STRAPLESS BRASSIERE

FIELD OF THE INVENTION

Our present invention relates to a button clip, especially for a strapless brassiere and, more particularly, to a clip adapted to clamp onto a garment, e.g. for securing a strap thereto, and having the appearance of a button or the like.

BACKGROUND OF THE INVENTION

While a wide variety of garment fasteners are available, for example, to secure a strap to another part of a garment such as a brassiere, there is a challenge to provide fasteners which not only can function effectively for the purpose but which also have an aesthetic character and can provide a decorative element. Button fasteners are widely used because the portions of the buttons which are exposed can be highly decorative.

In many cases it is desirable to provide a fastener which does not have a part permanently attached to the fabric portion to which a strap or the like is to be affixed. This can be the case of a strapless brassiere which may not have facilities for attachment of a strap and which, in some cases, may be worn by a person desiring a strap for aesthetic or support reasons.

OBJECTS OF THE INVENTION

It is, therefore, the principal object of the present invention to provide an improved fastener, especially for garments and particularly for a strap to be attached to a strapless brassiere, which satisfies the above-mentioned requirements, is convenient to use and is of aesthetic character.

A more specific object is to provide an improved clip-type fastener which is reliable, secure against release and has an aesthetic appearance.

It is also an object of the invention to provide a highly decorative fastener, especially for straps to be optionally affixed to a strapless brassiere.

A further object is to provide a strapless brassiere with an optional strap and clip assembly with reliable attachment of the strap to the strapless brassiere and a pleasing appearance.

SUMMARY OF THE INVENTION

These objects and others which will become more readily apparent hereinafter are attained, in accordance with the invention, in a button clip which comprises a pair of tongues affixed at one end to a pair of plates adapted to straddle the end of a strap and to be welded thereto and a slider shiftable along the tongues and adapted to press the opposite ends together against the fabric of a garment to which the clip is secured. According to a feature of the invention, the slider has the configuration of a button and is generally annular with a central opening through which the surface of one of the tongues can be exposed.

The tongues may be of progressively increasing thickness toward the end engageable with the garment so as to be cammed tightly thereagainst by the movement of the slider at this end.

Advantageously, the confronting surfaces of the tongues at this end are toothed to grip the garment firmly according to another feature of the invention, the ends of the tongues secured to plates are traversed by pins of one of the plates. The portions of the plates secured to the strap, in turn, may be provided with formations facilitating the attachment of these plates to the strap by ultrasonic or thermal welding.

According to a feature of the invention, the tongues and the slide button are of different colors and possibly of different textures so as to enhance the aesthetic effect to the clip. The plates can advantageously be of the same color as the slide button and all of the parts of the button clip can be injection-molded of polyoxymethylene and/or polyurethane as may be desired.

It has been found to be advantageous to define the opening in the slide with a ridge or rim separated by a groove from a wider framing portion of the slide.

The invention also encompasses a strap provided at its ends with a pair of such button clips which can be attached to opposite sides of a strapless brassiere, for example, when the strapless garment is not provided with buttonholes or strap attachments so that the wearer can affix the optional straps to the brassiere if the brassiere is to be worn as a strap brassiere.

The brassiere itself, provided with the straps and clips, is also deemed to be part of this invention.

BRIEF DESCRIPTION OF THE DRAWING

The above and other objects, features, and advantages will become more readily apparent from the following description, reference being made to the accompanying drawing in which.

SPECIFIC DESCRIPTION

Figure 2:
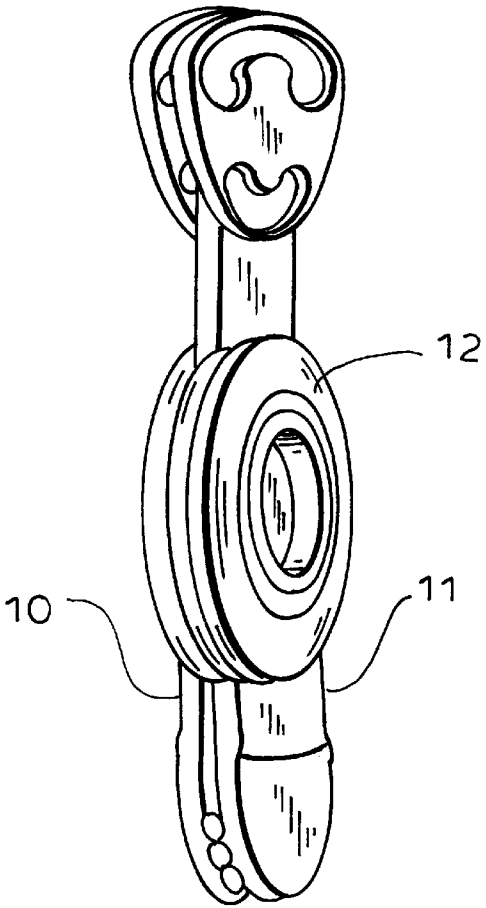
FIG. 2 is a perspective view partly from the side showing the clip in its closed position.
Figure 1:
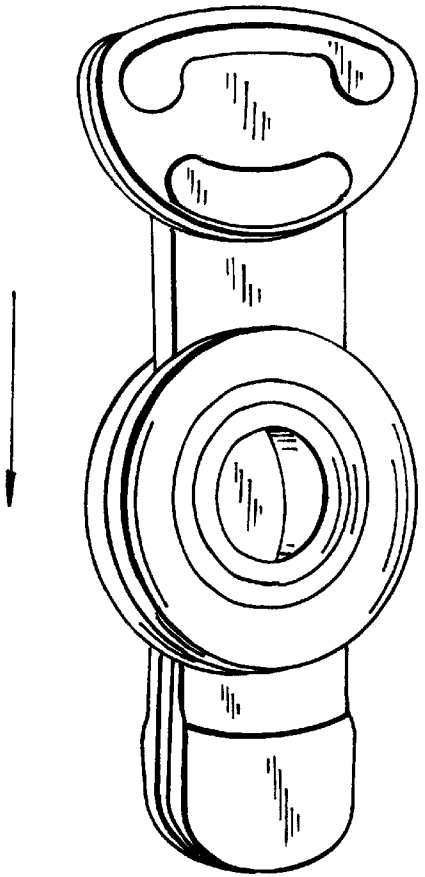
FIG. 1 is a front elevational view of a button clip according to the invention.
Figure 4:
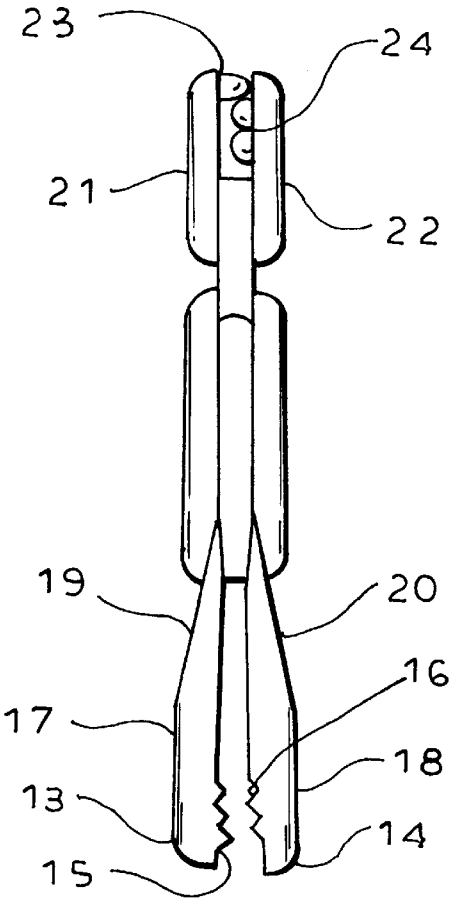
FIG. 4 is a side elevational view of the clip in its open position.
Figure 3:
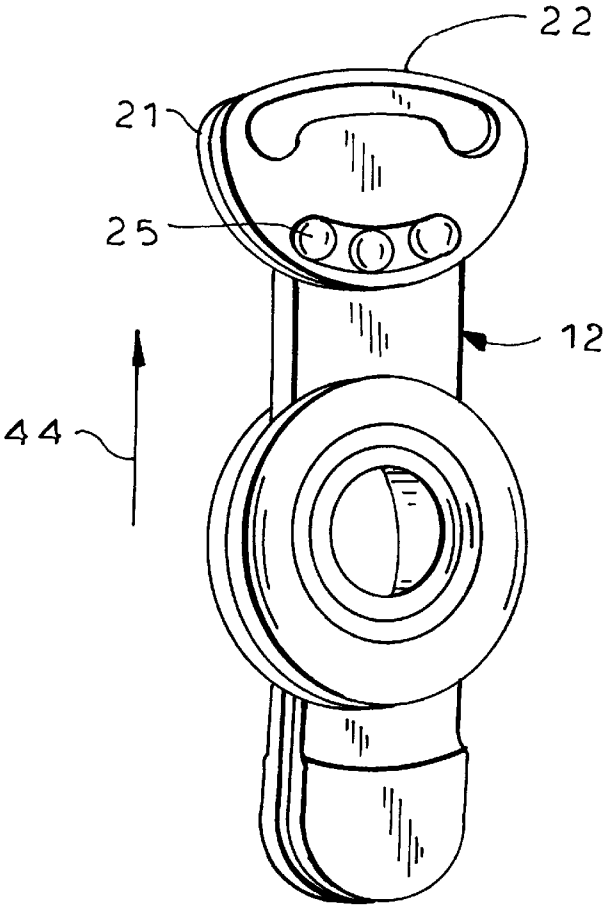
FIG. 3 is a view similar to FIG. 1 but showing the clip in its open position.

As can be seen from FIGS. 1–4, for example, the button clip of the invention comprises a pair of tongues 10 and 11 which can be pressed together by movement of a slider 12 therealong. The tongues 10 and 11 are formed with ends 13 and 14 adapted to grip a garment and formed with teeth 15 and 16 on the confronting surfaces. The tongues have thicker regions 17 and 18 toward the clamping end and are provided with ramp surfaces 19 and 20 leading to these thickened regions and which are cammed toward one another when the slide 12 is pressed toward the ends 13, 14.

At their opposite ends, the tongues 10 and 11 are engaged between a pair of shield-shaped plates 21 and 22 which are provided with formations 23, 24 along their confronting surfaces for engagement with a strap. The plates 21 and 22 are composed of thermoplastic material and can be ultrasonically or thermally welded to the strap which may also be composed of a synthetic resin filament fabric to facilitate attachment by welding thereto.

Figure 5:
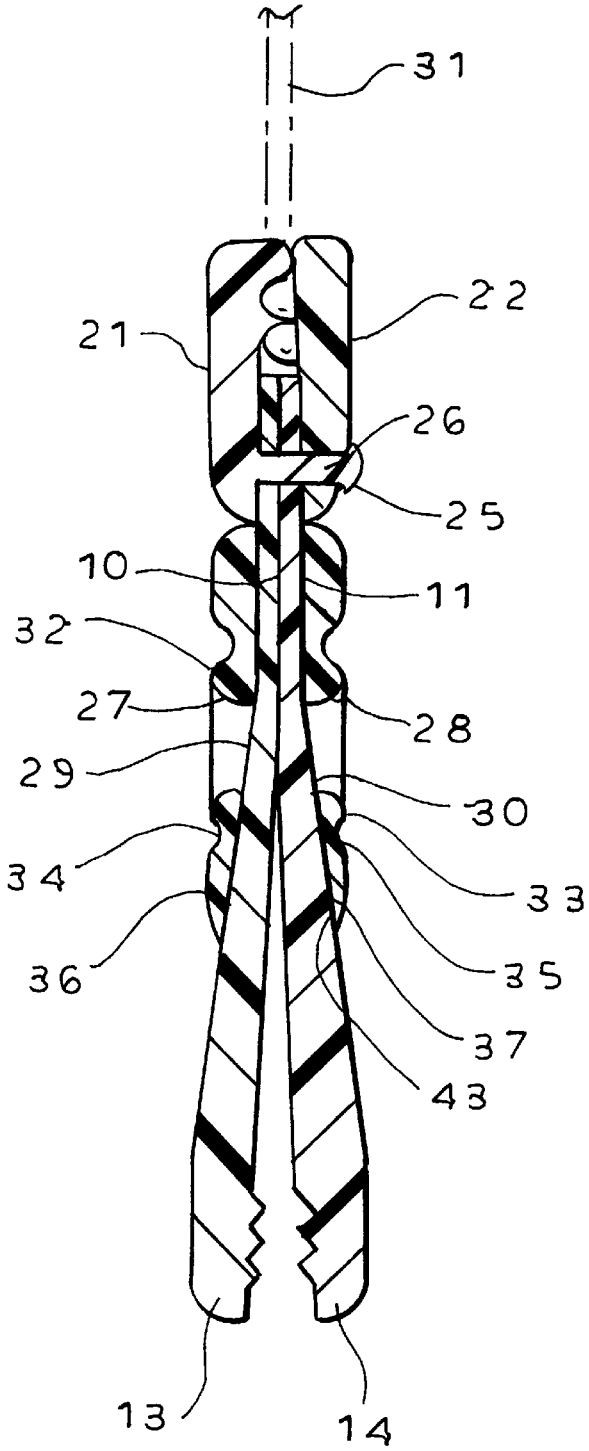
FIG. 5 is a cross sectional view through the clip in its open position and drawn to a much larger scale.

The plate 21 is provided with pins 25 extending through holes 26 in the plate 22 (see FIG. 5) and through corresponding holes in the tongues 10 and 11. As is also visible from FIGS. 1–5, the slider 12 has the configuration of a circular button and is provided with openings 27 and 28 through which the surfaces 29 and 30 of the tongues 10 and 11 are visible. The strap fabric has been represented at 31 in FIG. 5 and from FIG. 5 it is also apparent that the openings 17 and 28 are framed by narrow ridges 32 and 33 separated by grooves 34 and 35 from larger bulges 36 and 37.

It will be apparent from FIGS. 1–4 that the plates 21 and 22 and the slider 12 are composed of synthetic resin material of one color while the tongues 10 and 11 are composed of a synthetic resin material of another color. These parts have different finishes, for example, smooth and matte finishes, respectively, and can be textured similarly or differently as desired. The preferred material for the clip is polyoxymethylene or polyurethane.

Figure 6:
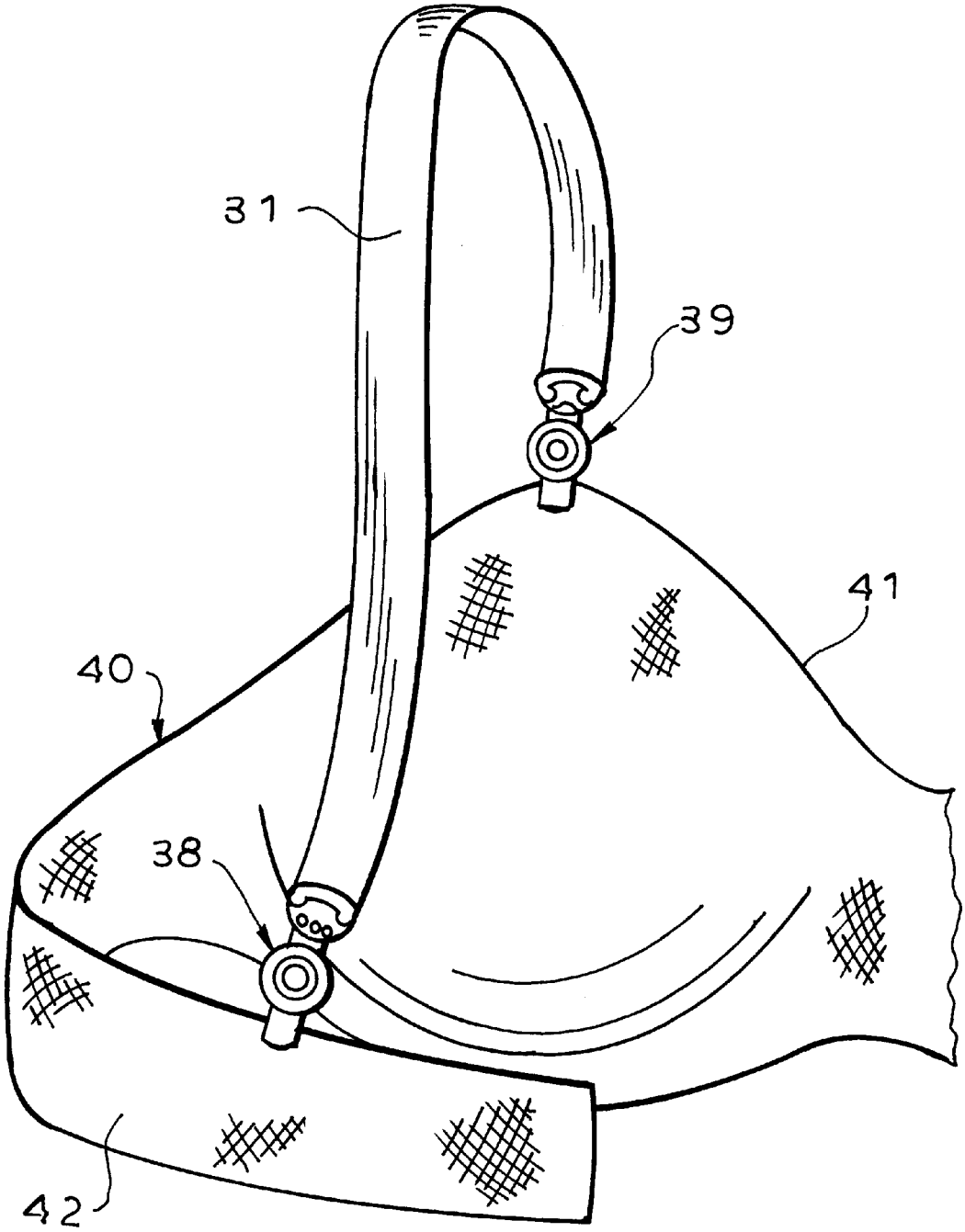
FIG. 6 is a perspective view of a portion of a brassiere having a strip with button clips according to the invention.

In use the clips are attached to a strap 31 by ultrasonic or thermal welding and the resulting strap can, as has been shown in FIG. 6, be provided with two such clips 38 and 39 at its opposite ends. The strap can be used to grip opposite sides of a strapless brassiere 40 and in FIG. 6 this brassiere is shown to have a cup 41 and a back strap 42. The other half of the brassiere and strap 31 has not been shown. The strap and clip assembly may be used when the wearer desires the additional support that such a strap can provide for the strapless brassiere or desires the aesthetic effect that the combination of the fabric strap 31 and the decorative clips 38, 39 can provide.

The slider 12 can have camming surfaces 43 designed to press the ends 13 and 14 of the clip together against the garment 40 when the slider 12 is displaced in a direction opposite to the arrow 44 to clamp the clip. Arrow 44, therefore, represents the direction of movement of the slider to open the clip.

Figure 7:
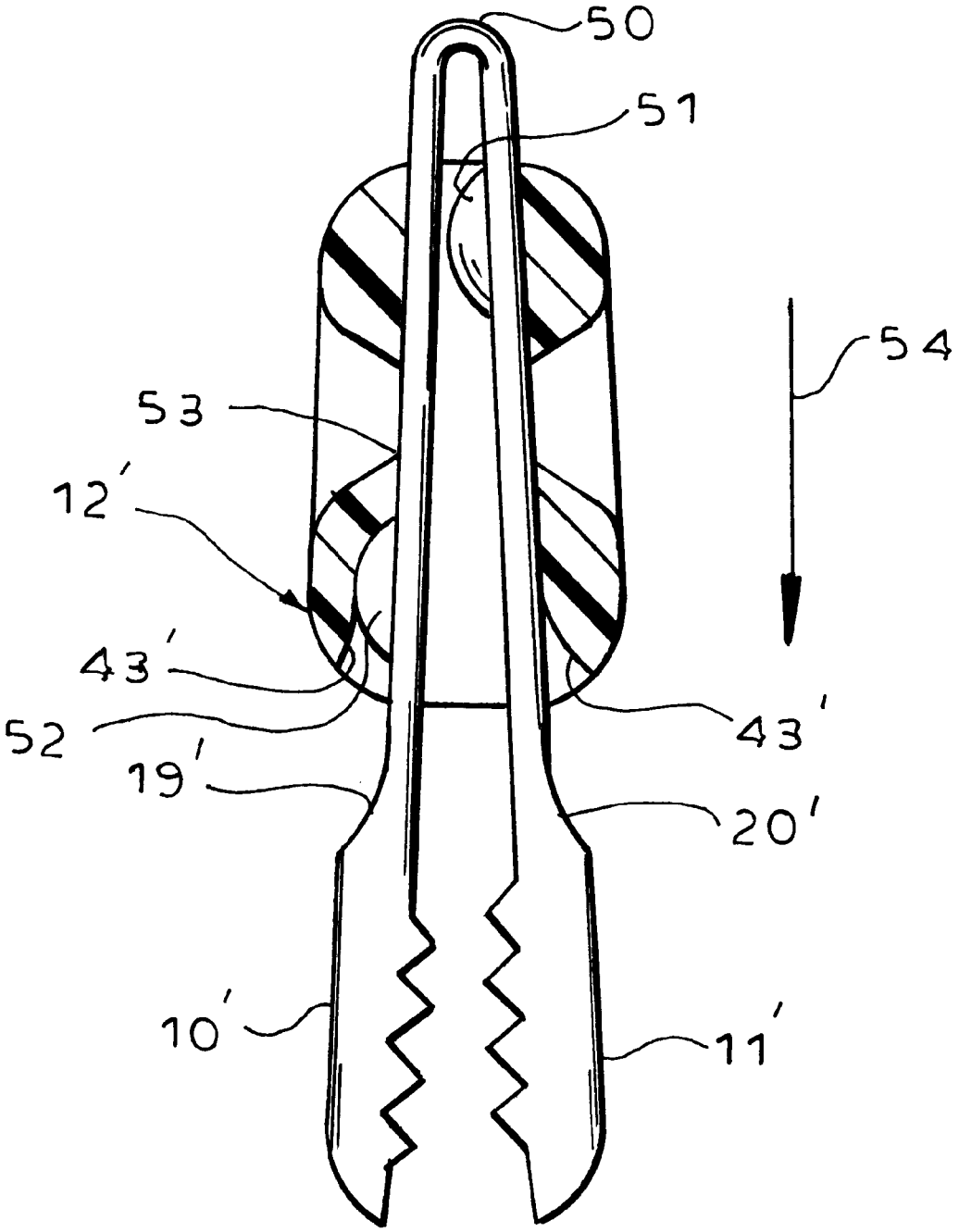
FIG. 7 is a diagrammatic cross sectional view showing another feature of the invention.
Figure 8:
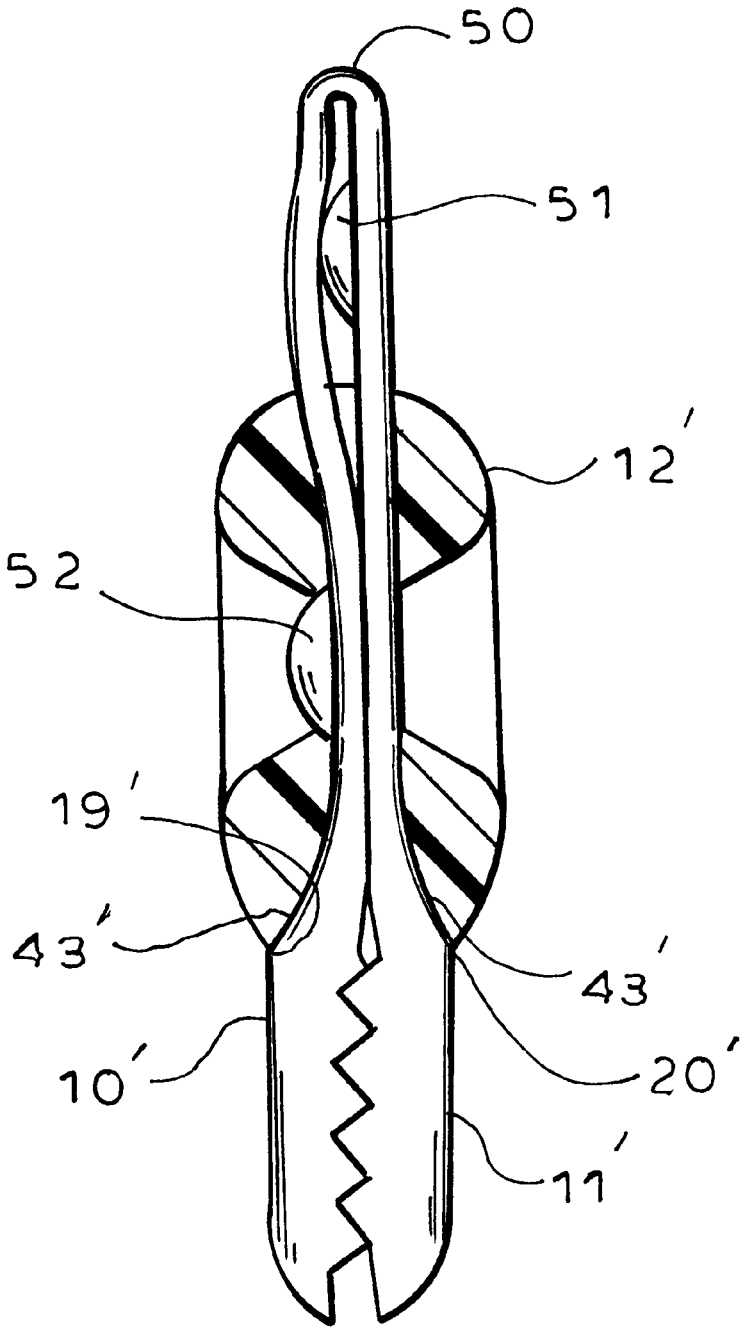
FIG. 8 is a view similar to FIG. 7 and likewise slightly exaggerated in form illustrating an alternative position.

FIGS. 7 and 8 show the tongues 10' and 11', slightly exaggerated in an open position and closed position, respectively. As can be seen from FIGS. 7 and 8, the welding flanges of the button clip having not been shown here, the tongues 10' and 11' can be interconnected at 50 so as to form one piece of a relatively soft material, for example, the polyurethane mentioned earlier. Of course two separate tongues held together by the welding flanges can be provided as well. Between the two tongues and close to the ends which are secured together, a hemispherical formation 51 can be provided to assist in pressing upon tongues when the slide 12' is in its retracted position. When the tongues are closed so that they are clamped on a garment, the hemispherical formation 51 produces a bulge in the tongue 10', adjacent the connection 50 between these tongues.

Another hemispherical formation 52 can be provided on the tongue 10' and can spring into the opening 53 of the slide 12' (compare FIGS. 7 and 8), to form a detent retaining the slide 12' in its closed position (FIG. 8). The camming surfaces 43' of the slide and the corresponding ramps 19' and 20' of the tongues 10' and 11' may have an angle of inclination to the direction of displacement of the slide which renders the slide frictionally self-locking in the closed position so that the slide is held in the closed position not only by the detent 52 but also by the frictional engagement of these camming surfaces and ramps.

To prevent the slide from shifting along the tongue from the open position when the slide is not being manually displaced, the detent formation 52 can engage the end of the slide turned toward the free ends of the tongue (FIG. 7). From this position, when the slide is urged in the direction of the arrow 54, the slide rides over the detent 52, pressing the tongues together and locks when the detent 52 engages in the opening 53. The slide can be of a harder material than the tongues, i.e. the polyoxymethylene mentioned earlier.

We claim:

1. A garment comprising a strapless brassiere, at least one strap connecting two parts of said strapless brassiere; and respective button clips connected between said straps and said strapless brassiere, each of said button clips comprising:

a pair of elongated resilient tongues formed at one end as surfaces engageable with said brassiere and having an opposite end;

a pair of plates affixed to said tongues at said opposite ends, adapted to straddle said strap and adapted to be affixed to said strap; and a slider on said tongues between said ends and movable therealong to press said surfaces against fabric of said brassiere, said slider having the configuration of a button.

2. The garment defined in claim 1 wherein said slider is of annular configuration and is formed on at least one side with an opening through which a surface of a respective one of said tongues is visible.

3. The garment defined in claim 2 wherein said slider is formed with openings on both sides and has rims surrounding said openings and separated by grooves from respective annular bulges.

4. The garment defined in claim 3 wherein said slider is circular.

5. The garment defined in claim 3 wherein said tongues have portions of increased thickness in the region of said surfaces and ramps extending toward said regions and cammed together by movement of said slider along said tongues.

6. The garment defined in claim 5 wherein said surfaces are formed with teeth.

7. The garment defined in claim 5 wherein said plates are provided with formations facilitating welding of said plates to said strap.

8. The garment defined in claim 7 wherein one of said plates is formed with at least one pin extending through said tongues and into a hole in the other of said plates.

9. The garment defined in claim 5 wherein said plates and said slider are of one color and said tongues are of another color.

10. A button clip for attaching a strap to a garment comprising:

a pair of elongated resilient tongues formed at one end as surfaces engageable with a garment and having an opposite end;

a pair of plates affixed to said tongues at said opposite ends, adapted to straddle said strap and adapted to be affixed to said strap; and a slider on said tongues between said ends and movable therealong to press said surfaces against fabric on said garment, said slider having the configuration of a button, said slider being of annular configuration and being formed on at least one side with an opening through which a surface of a respective one of said tongues is visible.

11. The clip defined in claim 10 wherein said slider is formed with openings on both sides and has rims surrounding said openings and separated by grooves from respective annular bulges.

12. The clip defined in claim 11 wherein said slider is circular.

13. The clip defined in claim 11 wherein said tongues have portions of increased thickness in the region of said surfaces and ramps extending toward said regions and cammed together by movement of said slider along said tongues.

14. The clip defined in claim 13 wherein said surfaces are formed with teeth.

15. The clip defined in claim 13 wherein said plates are provided with formations facilitating welding of said plates to said strap.

16. The clip defined in claim 13 wherein one of said plates is formed with at least one pin extending through said tongues and into a hole in the other of said plates.

17. The clip defined in claim 13 wherein said plates and said slider are of one color and said tongues are of another color.

18. The clip defined in claim 13 wherein said plates, said slider and said tongues are injection molded of synthetic resin material.

19. A button clip for attaching a strap to a garment comprising:

a pair of elongated resilient tongues formed at one end as surfaces engageable with a garment and having an opposite end;

a pair of plates affixed to said tongues at said opposite ends, adapted to straddle said strap and adapted to be affixed to said strap; and a slider on said tongues between said ends and movable therealong to press said surfaces against fabric on said garment, said slider having the configuration of a button, said tongues being composed of a relatively soft material and said slider of a relatively hard material.

20. The clip defined in claim 19 wherein said tongues are formed in one piece and are connected between said plates.

21. The clip defined in claim 19 further comprising a formation between said tongues for pressing said tongues into an open position upon movement of said slider toward said opposite ends.

22. A button clip for attaching a strap to a garment comprising:

a pair of elongated resilient tongues formed at one end as surfaces engageable with a garment and having an opposite end;

a pair of plates affixed to said tongues at said opposite ends, adapted to straddle said strap and adapted to be affixed to said strap;

a slider on said tongues between said ends and movable therealong to press said surfaces against fabric on said garment, said slider having the configuration of a button; and a detent formation on one of said tongues engageable in an opening in said slider upon movement of said slider toward said one ends of said tongues for retaining said tongues in engagement with said fabric.

* * * * *